US007721373B1

(12) United States Patent
Wilson

(10) Patent No.: US 7,721,373 B1
(45) Date of Patent: May 25, 2010

(54) RAILROAD FLANGEWAY CLEANER SYSTEM

(76) Inventor: Timothy R. Wilson, 1805 - 2nd Ave. North, Moorhead, MN (US) 56560

( * ) Notice: Subject to any disclaimer, the term of this patent is extended or adjusted under 35 U.S.C. 154(b) by 407 days.

(21) Appl. No.: 11/426,322

(22) Filed: Jun. 26, 2006

(51) Int. Cl.
*B61F 19/00* (2006.01)

(52) U.S. Cl. ..... 15/55; 15/54

(58) Field of Classification Search ..... 15/54, 15/55

See application file for complete search history.

(56) References Cited

U.S. PATENT DOCUMENTS 414,511 A * 11/1889 Fisher ..... 37/209
496,049 A * 4/1893 Fleming ..... 15/55
2,719,312 A * 10/1955 Hyland ..... 15/55
5,540,004 A * 7/1996 Patterson et al. ..... 37/244
5,695,574 A * 12/1997 Falardeau et al. ..... 134/6
6,601,374 B2 * 8/2003 Smith ..... 56/13.6

* cited by examiner

*Primary Examiner*—Joseph J Hail, III
*Assistant Examiner*—Shantese McDonald
(74) *Attorney, Agent, or Firm*—Neustel Law Offices

(57) ABSTRACT

A railroad flangeway cleaner system for efficiently clearing debris and other foreign material from a railroad flangeway or other similar channel. The railroad flangeway cleaner system includes a frame for traveling along a channel, a drive unit attached to the frame and a cleaning device rotated by the drive unit, wherein the cleaning device clears the channel of debris.

17 Claims, 7 Drawing Sheets

RAILROAD FLANGEWAY CLEANER SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to cleaning devices and more specifically it relates to a railroad flangeway cleaner system for efficiently clearing debris and other foreign material from a railroad flangeway or other similar channel.

2. Description of the Related Art

Any discussion of the prior art throughout the specification should in no way be considered as an admission that such prior art is widely known or forms part of common general knowledge in the field.

Cleaning devices have been in use for years. Typically, cleaning devices include many various apparatuses (i.e. brooms, shovels, automatic sweepers, etc.). Railroad flangeways are generally channels in-between the rails of the railroad track and the road. The flangeways are generally located where the road crosses the railroad tracks. These channels are generally of a small width (i.e. 2-3 inches) and small depth (i.e. 2-3 inches). Over time the flangeways can fill up with many types of debris (i.e. sand, snow, small rocks, etc.). Clogged flangeways can be a leading cause of train derailments, among other things.

Flangeways are generally too small to accommodate many types of automatic sweepers, which usually leave the flangeway to be cleaned out with a broom or other manually operated device. Cleaning the numerous flangeways out manually, with a broom or other manual operated device, can be very tedious. The cost of labor for cleaning the flangeways out can also be an overly expensive and unnecessary expense.

While these devices may be suitable for the particular purpose to which they address, they are not as suitable for efficiently clearing debris and other foreign material from a railroad flangeway or other similar channel. Cleaning out railroad flangeways with manually operated devices (i.e. broom, shovel, etc.) can be very time consuming and overall miserable work.

In these respects, the railroad flangeway cleaner system according to the present invention substantially departs from the conventional concepts and designs of the prior art, and in so doing provides an apparatus primarily developed for the purpose of efficiently clearing debris and other foreign material from a railroad flangeway or other similar channel.

BRIEF SUMMARY OF THE INVENTION

In view of the foregoing disadvantages inherent in the known types of cleaning devices now present in the prior art, the present invention provides a new railroad flangeway cleaner system construction wherein the same can be utilized for efficiently clearing debris and other foreign material from a railroad flangeway or other similar channel.

The general purpose of the present invention, which will be described subsequently in greater detail, is to provide a new railroad flangeway cleaner system that has many of the advantages of the cleaning devices heretofore and many novel features that result in a new railroad flangeway cleaner system which is not anticipated, rendered obvious, suggested, or even implied by any of the prior art cleaning devices, either alone or in any combination thereof.

To attain this, the present invention generally comprises a frame for traveling along a channel, a drive unit attached to the frame and a cleaning device rotated by the drive unit, wherein the cleaning device clears the channel of debris.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a railroad flangeway cleaner system that will overcome the shortcomings of the prior art devices.

A second object is to provide a railroad flangeway cleaner system for efficiently clearing debris and other foreign material from a railroad flangeway or other similar channel.

Another object is to provide a railroad flangeway cleaner system that may be adjusted vertically to clean different depths.

An additional object is to provide a railroad flangeway cleaner system that is adjustable in overall length.

A further object is to provide a railroad flangeway cleaner system that is powered by hydraulics.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
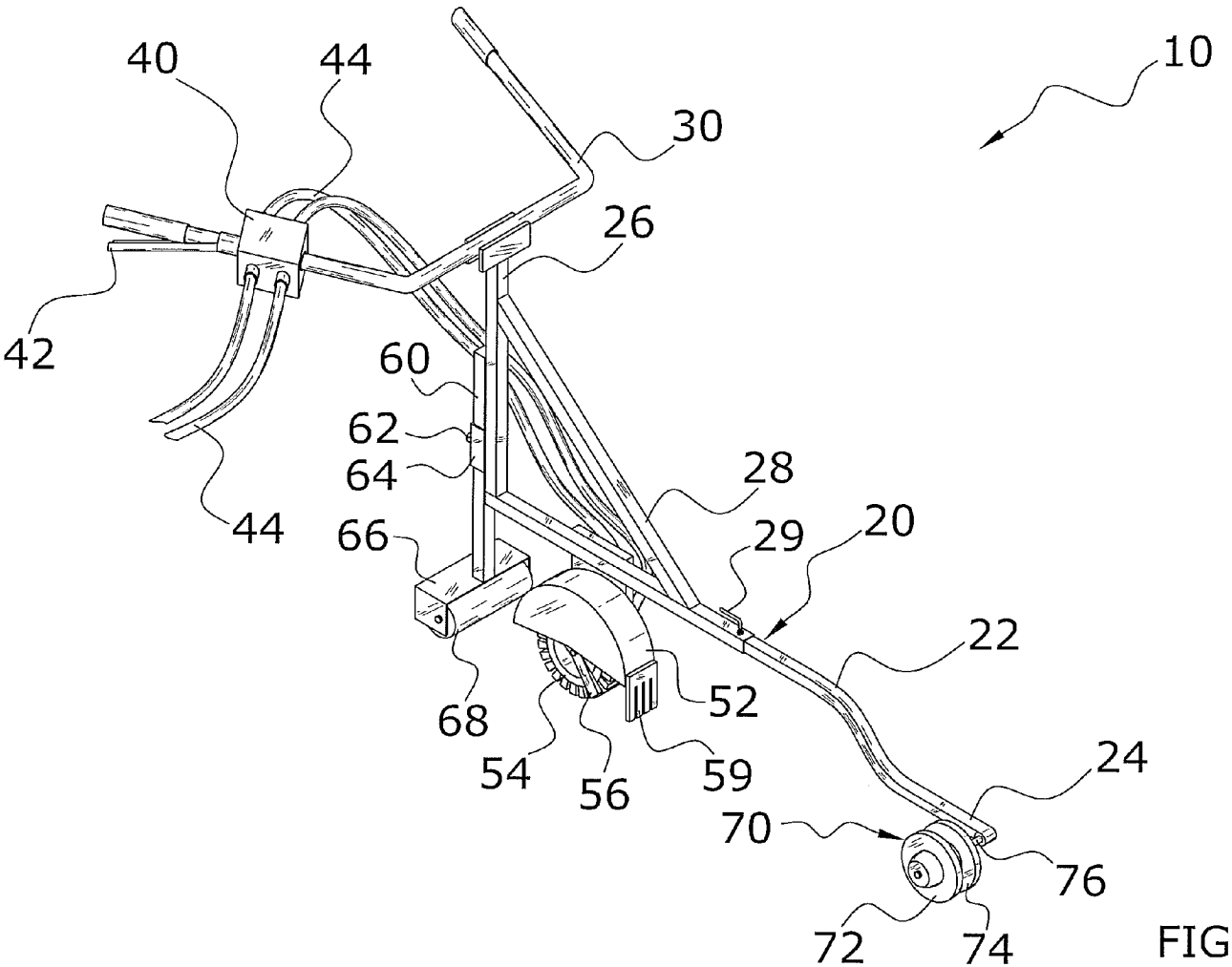
FIG. 1 is an upper perspective view of the present invention.

Turning now descriptively to the drawings, in which similar reference characters denote similar elements throughout the several views, FIGS. 1 through 7 illustrate a railroad flangeway cleaner system 10, which comprises a frame 20 for traveling along a channel, a drive unit 50 attached to the frame 20 and a cleaning device 54 rotated by the drive unit 50, wherein the cleaning device 54 clears the channel of debris.

B. Frame

The frame 20 is preferably comprised of a tubular square structure and configuration, as shown in FIGS. 1 through 7. The frame 20 preferably includes a support member 22. The support member 22 preferably extends longitudinally across the railroad flangeway cleaner system 10. Attached to the support member 22 on the rear of the railroad flangeway cleaner system 10 is preferably a vertical member 26. The vertical member 26 preferably extends upward and perpendicular to the support member 22, as shown in FIGS. 1 through 6.

The frame 20 also preferably includes a cross member 28 that extends from an upper end of the vertical member 26 to the far end of the support member 22, as shown in FIGS. 1 through 6. This is for added support to the frame 20 while using the railroad flangeway cleaner system 10. At the front of the support member 22 and at the furthest point from the vertical member 26, the frame 20 preferably includes a first adjustment member 24, as shown in FIGS. 1 through 7.

C. First Adjustment Member

The first adjustment member 24 preferably has a smaller perimeter than the support member 22 and is able to slide inside of the support member 22 for adjustment. The first adjustment member 24 is locked in a desired position by a first fastener 29. The first fastener 29 is preferably comprised of a bolt structure and configuration. The first fastener 29 preferably locks the first adjustment member 24 in place by threadably screwing through the support member 22 and tightly against the first adjustment member 24. The first adjustment member 24 is able to longitudinally slide in and out of the support member 22 to better accommodate various flangeway 16 or channel lengths and road conditions.

Figure 5:
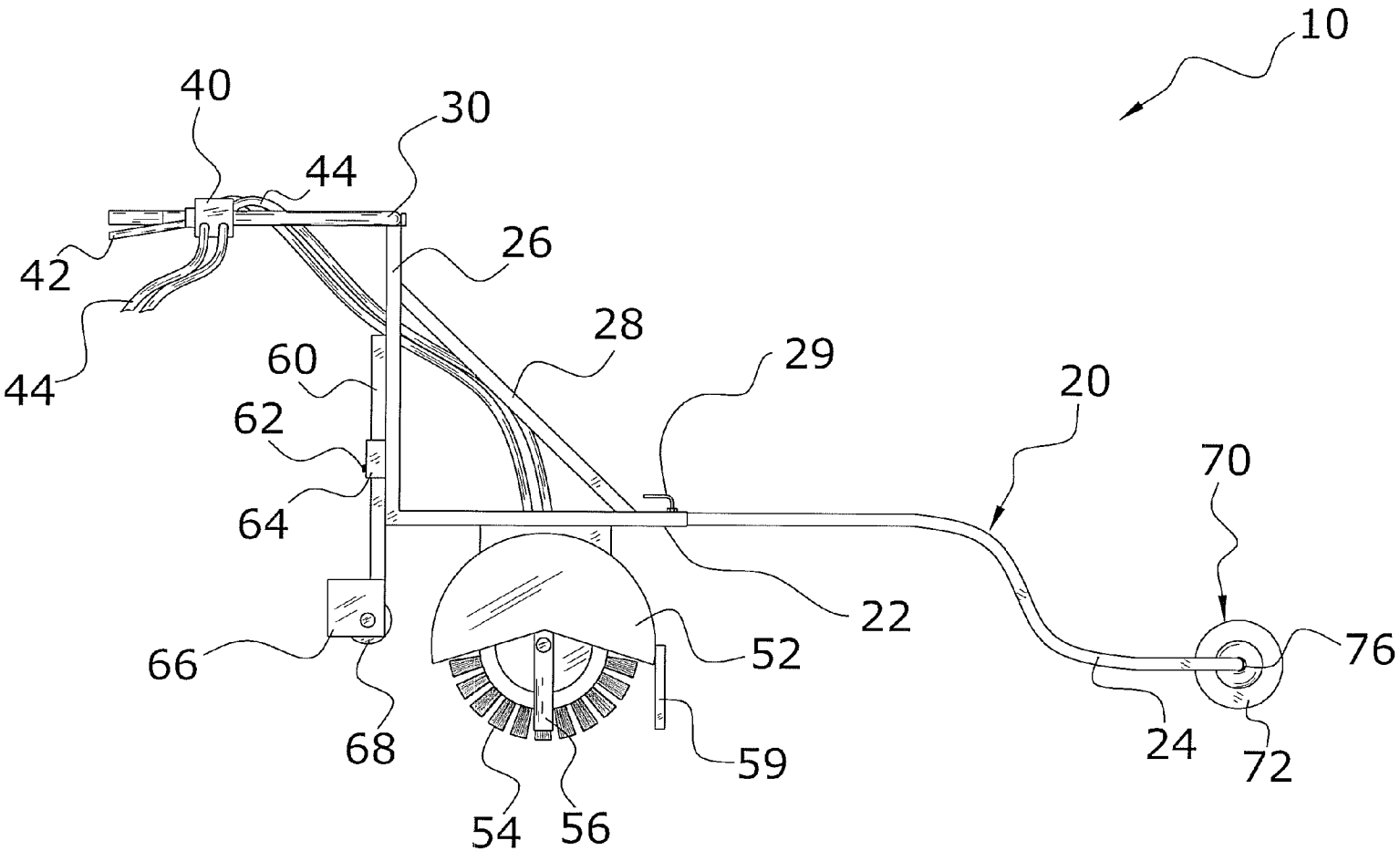
FIG. 5 is an opposite side view of the present invention.
Figure 6:
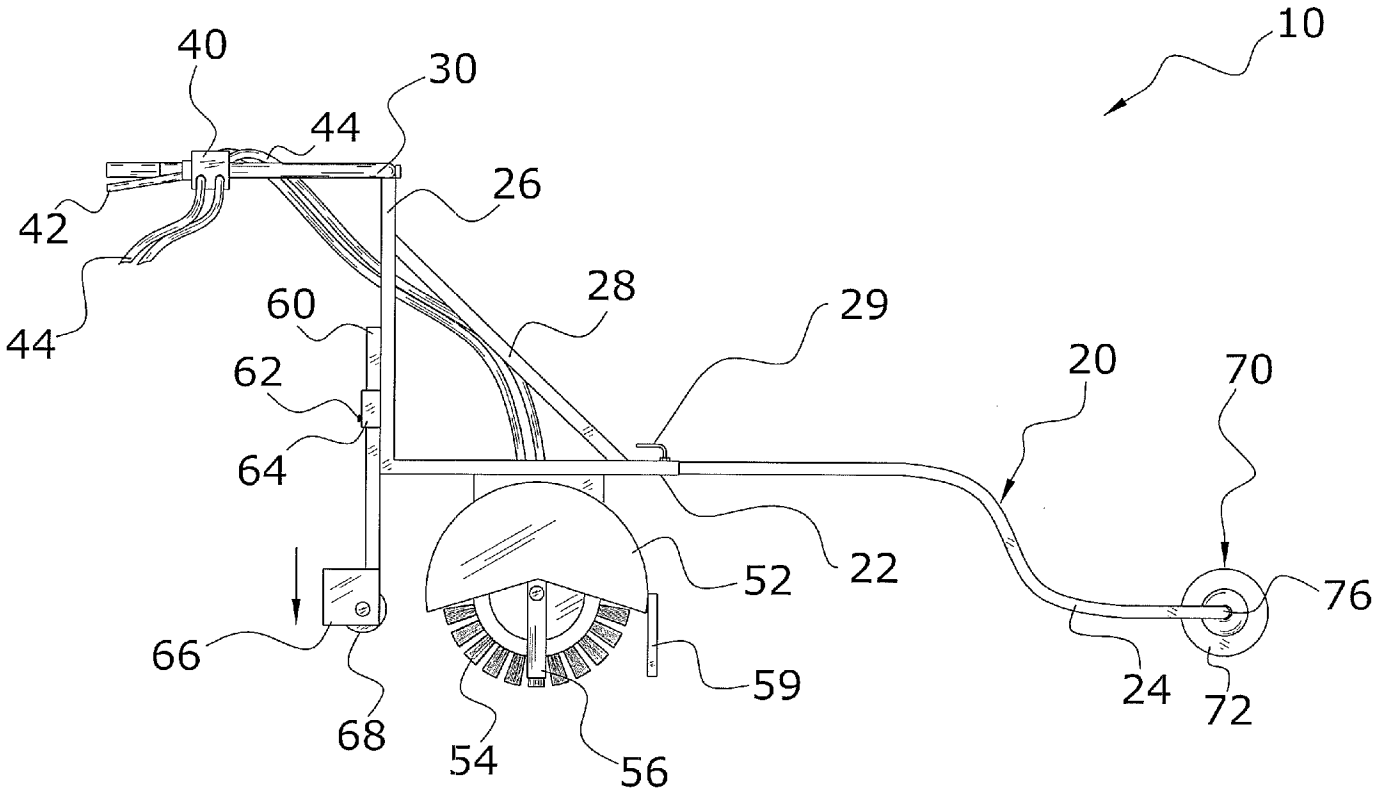
FIG. 6 is an opposite side view of the present invention vertically adjusted.
Figure 7:
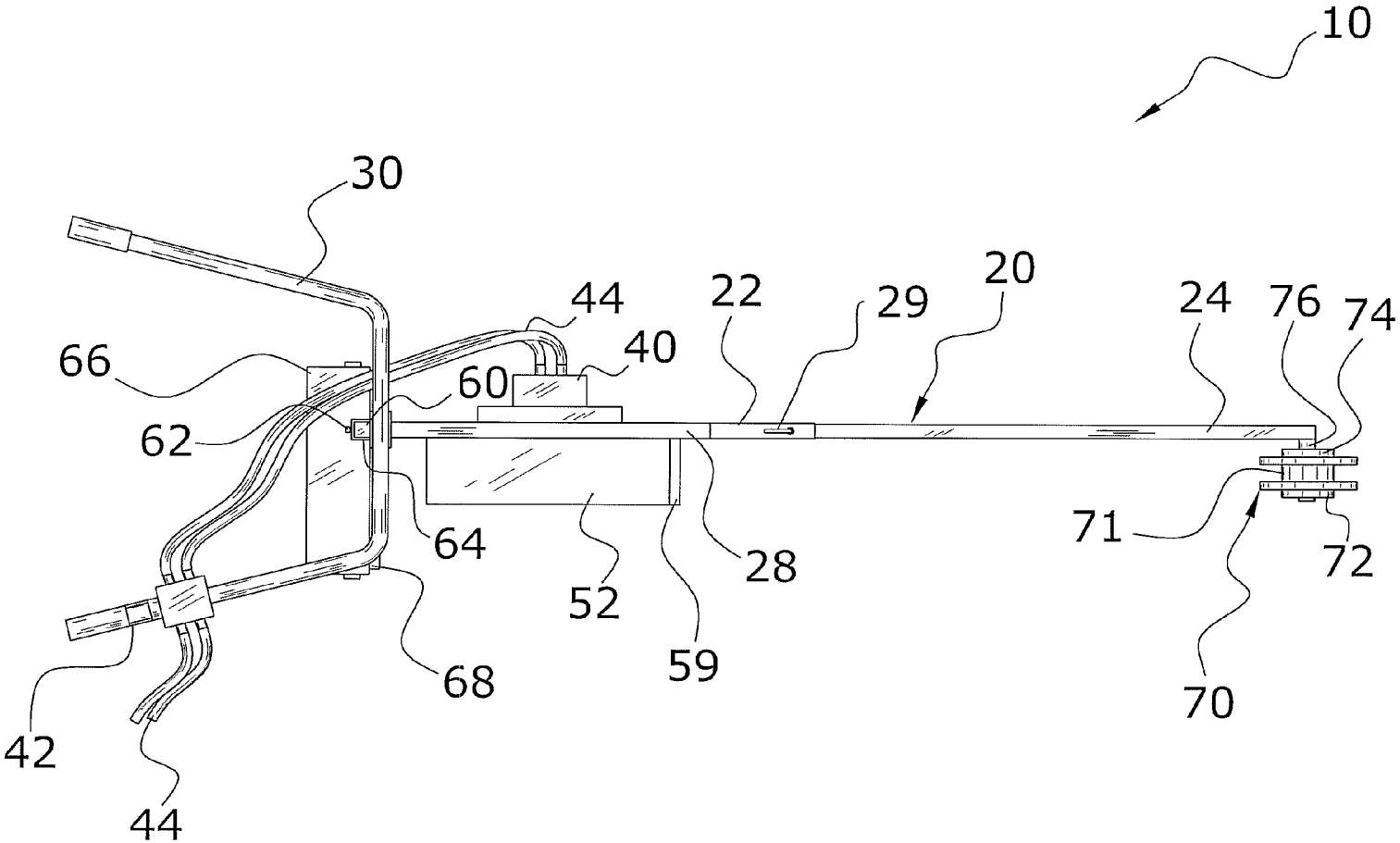
FIG. 7 is a top view of the present invention.

Near the opposite end of the first adjustment member 24, away from the support member 22, there is preferably a guide member 70, as shown in FIGS. 1 through 7. The guide member 70 preferably includes a first member 72 and a second member 74. The first member 72 and the second member 74 are preferably of a substantially similar structure and configuration, as shown in FIG. 7. The first member 72 and the second member 74 also preferably mirror each other.

Figure 2:
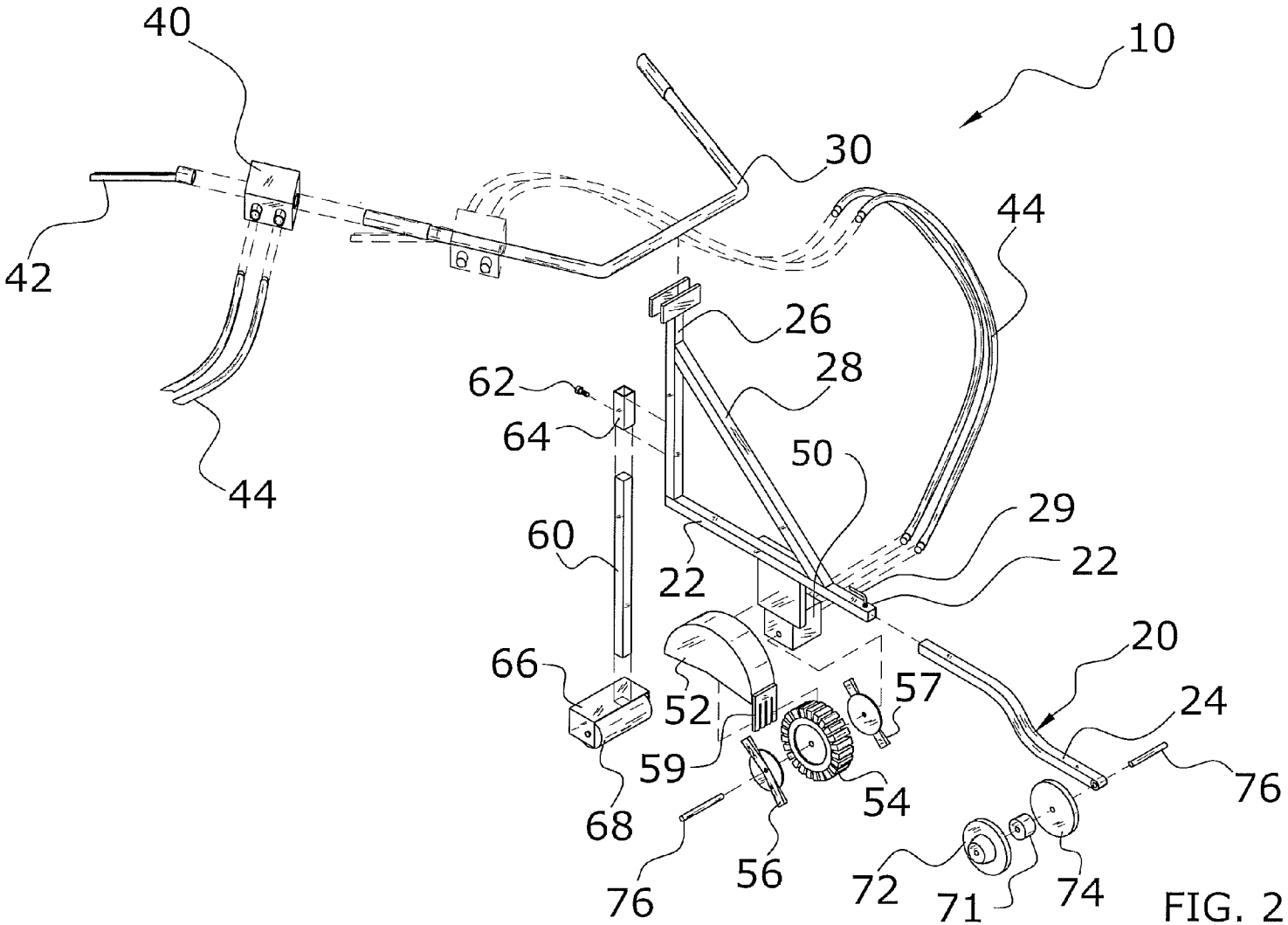
FIG. 2 is an exploded upper perspective view of the present invention.

A spindle 76 preferably runs through a bearing near an end of the first adjustment member 24, furthest from the support member 22. The spindle 76 preferably connects the first adjustment member 24 to the first member 72, the second member 74 and at least one spacer 71, as shown in FIG. 2.

Figure 3:
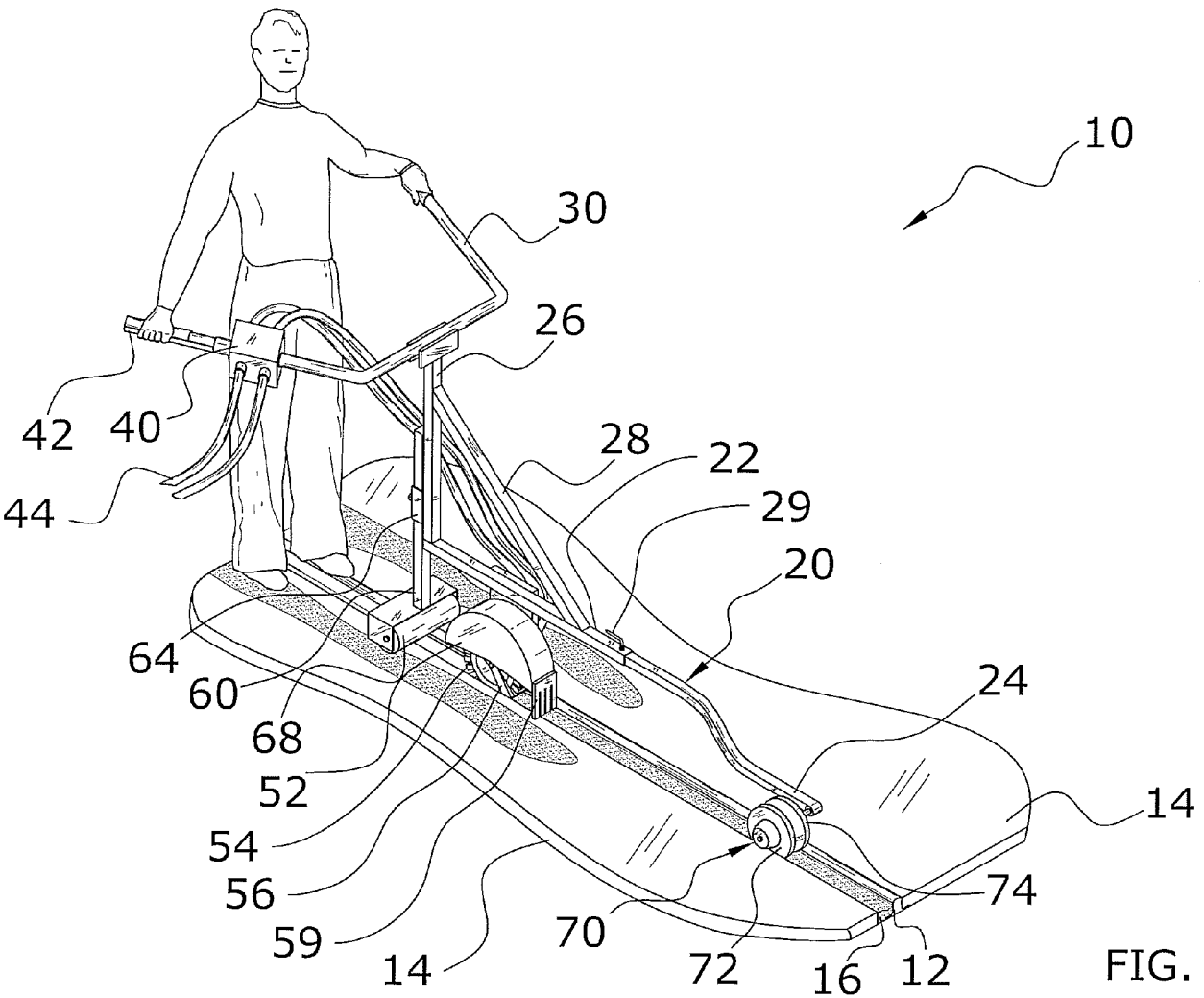
FIG. 3 is an upper perspective view of the present invention in use.

At least one spacer 71 preferably fits in-between the first member 72 and the second member 74. The spacers 71 are preferably an adequate width so that the first member 72 and the second member 74 are able to follow along the inner edges of the flangeway 16 or channel, as shown in FIG. 3. The guide member 70 preferably directs the railroad flangeway cleaner system 10 along the flangeway 16 or channel.

D. Second Adjustment Member

Figure 4:
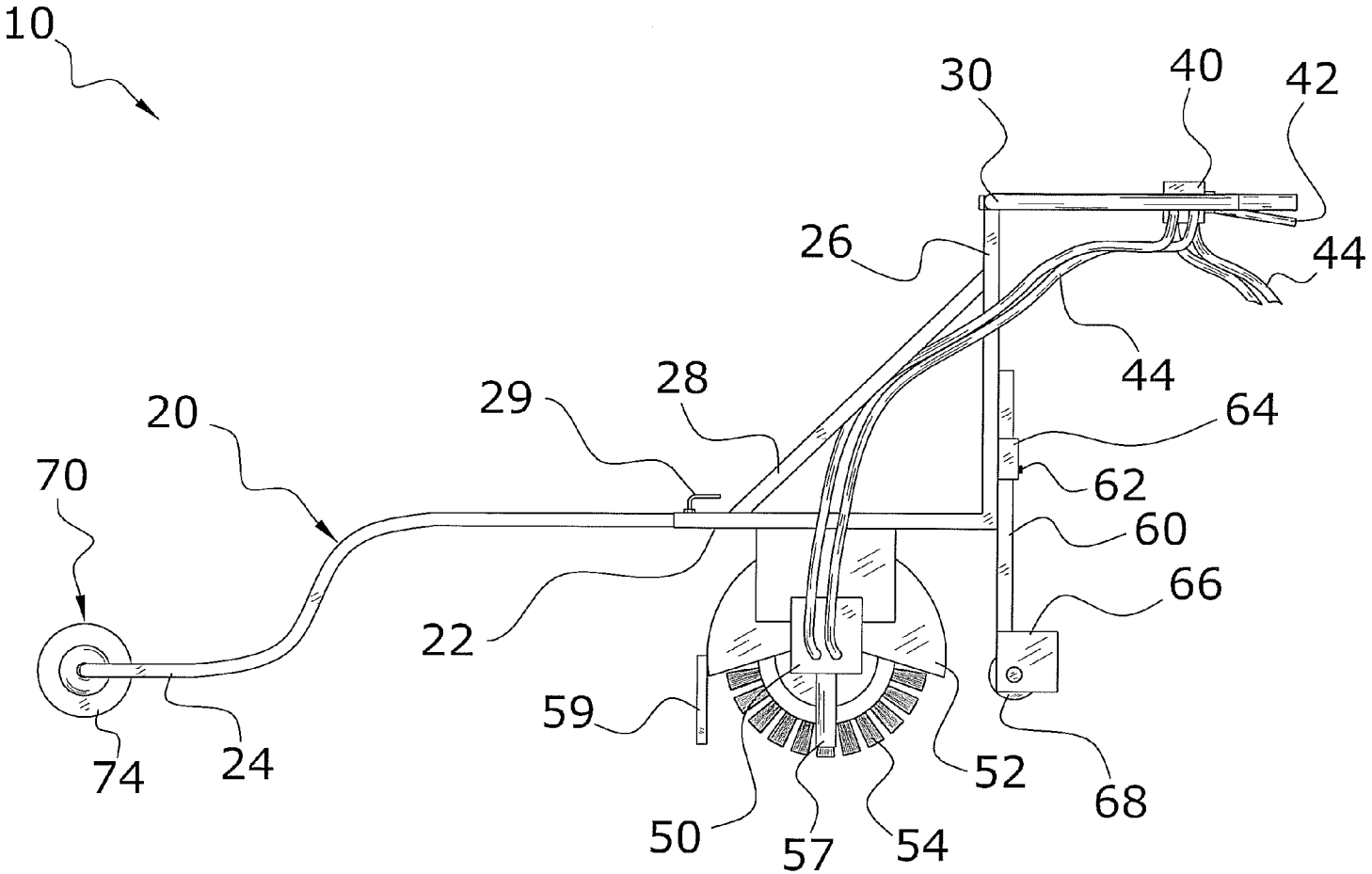
FIG. 4 is a side view of the present invention.

Near the vertical member 26, the frame 20 preferably includes a second adjustment member 60, as shown in FIGS. 1 through 6. The second adjustment member 60 preferably adjusts vertically or latitudinally. The second adjustment member 60 preferably slides through a bracket 64. The bracket 64 is preferably attached to the rear of the railroad flangeway cleaner system 10 and to a lower end of the vertical member 26. Adjusting the second adjustment member 60 subsequently adjusts the depth of cleaning device 54 in the channel or flangeway 16, as shown in FIGS. 5 and 6.

The bracket 64 is preferably comprised of a square tubular structure and configuration, as shown in FIG. 2. The perimeter of the bracket 64 is preferably greater than the perimeter of the second adjustment member 60. The second adjustment member 60 is locked at a desired height through the use of a second fastener 62. The second fastener 62 is preferably comprised of a bolt structure and configuration. The second fastener 62 preferably locks the second adjustment member 60 in place by threadably screwing the second fastener 62 through the bracket 64 and tightly against the second adjustment member 60, as shown in FIGS. 1 through 6.

At the vertically lowest end of the second adjustment member 60, there is preferably a roller 68, as shown in FIGS. 1 through 6. The roller 68 is preferably of a cylindrical structure and configuration. The roller 68 preferably rolls along a top of the flangeway 16 or channel. The roller 68 keeps the cleaning device 54 at a constant height with respect to the flangeway 16 or channel. A housing 66 preferably surrounds the upper half of the roller 68, as shown in FIGS. 1 through 7. The housing 66 supports the roller 68 and is attached to a lower end of the second adjustment member 60.

E. Handles

A handle 30 preferably attaches at the uppermost end of the vertical member 26, as shown in FIGS. 1 through 7. The handles 30 are preferably of a size and shape to be comfortably grasped by an operator while an operator is walking along a road surface 14 with the railroad flangeway cleaner system 10.

A control unit 40 is preferably attached to one end of the handles 30, as shown in FIGS. 1 through 7. The control unit 40 preferably receives a plurality of hydraulic hoses 44. The plurality of hydraulic hoses 44 preferably supply a power source to the railroad flangeway cleaner system 10.

The control unit 40 also outputs a plurality of hydraulic hoses 44. The hydraulic hoses 44 outputted from the control unit 40 are preferably received by the drive unit 50, as shown in FIGS. 2, 4 and 7. The hydraulic hoses 44 received by the drive unit 50 are preferably engaged when a trigger 42 is engaged.

The trigger 42 is also preferably connected to the control unit 40. The trigger 42 is preferably positioned on the handle nearest the control unit 40, as shown in FIGS. 1 through 7. The trigger 42 preferably functions as a standard trigger 42. The trigger 42 signals the drive unit 50 of the railroad flangeway cleaner system 10 when to start the cleaning device 54.

F. Drive Unit

The drive unit 50 is preferably comprised of a motor structure and configuration. The drive unit 50 is also preferably hydraulically driven. The drive unit 50 is preferably attached to the support member 22 of the frame 20. The drive unit 50 rotates a cleaning device 54 through the use of a spindle 76.

The cleaning device 54 is preferably comprised of a stiff bristle structure and configuration, as shown in FIGS. 1 through 6. The cleaning device 54 preferably includes a first blade 56 and a second blade 57. The first blade 56 and the second blade 57 are preferably of a substantially similar structure. The first blade 56 and the second blade 57 are preferably positioned on opposite sides of the cleaning device 54 and are also rotated by the drive unit 50 through the use of the spindle 76.

The first blade 56 and the second blade 57 rotate around with the cleaning device 54 and serve to remove large objects (i.e. rocks) from the flangeway 16 or channel. The overall width of the cleaning device 54 is less than the width of the flangeway 16 or channel.

An upper half of the cleaning device 54 is preferably surround by a shroud 52. The shroud 52 is preferably attached to the support member 22 directly across from the drive unit 50, as shown in FIGS. 1 through 7. The shroud 52 serves to protect an operator from debris and rocks that the cleaning device 54 kicks up from the flangeway 16 or channel. A front of the shroud 52 preferably includes a guard 59. The guard 59 is preferably of a mud flap structure and configuration. The guard 59 serves to further protect surrounding objects from debris and rocks that the cleaning device 54 kicks up during use.

G. In Use

In use, the operator first hauls the railroad flangeway cleaner system 10 to the desired flangeway 16 or channel that is desired to be cleaned. The hydraulic hoses 44 are then connected to the control unit 40 from a hydraulic power source. The hydraulic hoses 44 running from the control unit 40 to the drive unit 50 are also checked to make sure that they are properly connected. The second adjustment member 60 is then adjusted so that the bottom of the roller 68 is at a lower vertical position than the cleaning device 54.

The railroad flangeway cleaner system 10 is then rolled over to the flangeway 16 or channel to be cleaned. The roller 68 is positioned on the edge of the flangeway 16 or channel, with the railroad flangeway cleaner system 10 oriented towards the longitudinal center of the flangeway 16 or channel. The cleaning device 54 is positioned over the flangeway 16, while the guide member 70 is positioned in the flangeway 16 or channel, so as to guide the railroad flangeway cleaner system 10 straight through the flangeway 16 or channel. The first adjustment member 24 is then adjusted to a desired length. Then the second adjustment member 60 is adjusted so the cleaning device 54 is at a desired depth in the flangeway 16 or channel.

The railroad flangeway cleaner system 10 is now ready for operation. The operator stands behind the railroad flangeway cleaner system 10 and firmly grasps the handles 30. The operator then engages the trigger 42, activating the cleaning device 54. The operator pushes the railroad flangeway cleaner system 10 across the flangeway 16 or channel, while walking on the road surface 14, as shown in FIG. 3. When the flangeway 16 or channel is cleaned of debris, the operator disengages the trigger 42 and removes the railroad flangeway cleaner system 10 form the flangeway 16 or channel. The railroad flangeway cleaner system 10 may then be disconnected from the hydraulic power source and the railroad flangeway cleaner system 10 may be hauled to a different flangeway 16 or channel that is desired to be cleaned. The above process is simply repeated for other flangeways 16 or channels.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

I claim:

1. A railroad flangeway cleaner system, comprising:

a frame for traveling along a channel of a railroad;

wherein said frame includes a first adjustment member, wherein said first adjustment member adjusts said frame longitudinally;

a drive unit attached to said frame;

a cleaning device connected to said drive unit, wherein said cleaning device clears said channel of debris;

a handle extending from said frame, wherein said handle is positioned at a rearward end of said frame behind said cleaning device;

a trigger extending from said handle, wherein said trigger is adapted to control said cleaning device via said drive unit; and a guide member extending from said frame, wherein said guide member is positioned at a forward end of said frame in front of said cleaning device;

wherein said guide member is adapted to engage an inside of said channel in a rotating manner so as to move along said channel when clearing said channel of debris with said cleaning device.

2. The railroad flangeway cleaner system of claim 1, wherein said drive unit is powered by hydraulics.

3. The railroad flangeway cleaner system of claim 1, wherein said handle is attached to a vertical member of said frame.

4. The railroad flangeway cleaner system of claim 1, wherein said guide member includes a first member and a second member.

5. The railroad flangeway cleaner system of claim 1, wherein said frame includes a second adjustment member.

6. The railroad flangeway cleaner system of claim 5, wherein said second adjustment member is latitudinally adjustable.

7. The railroad flangeway cleaner system of claim 5, wherein said second adjustment member includes a roller.

8. The railroad flangeway cleaner system of claim 7, wherein said roller travels along a top of said channel.

9. The railroad flangeway cleaner system of claim 1, wherein said cleaning device is comprised of a stiff bristles.

10. The railroad flangeway cleaner system of claim 1, wherein said cleaning device includes a plurality of blades.

11. The railroad flangeway cleaner system of claim 1, wherein said frame includes a shroud.

12. The railroad flangeway cleaner system of claim 11, wherein said shroud covers an upper half of said cleaning device.

13. The railroad flangeway cleaner system of claim 1, wherein said frame includes a cross member.

14. A walk behind railroad flangeway cleaner system, comprising:

a frame for traveling along a channel of a railroad;

a handle extending from said frame for directing said frame while walking along said channel of said railroad;

a drive unit attached to said frame;

a cleaning device connected to said drive unit, wherein said cleaning device clears said channel of debris;

a trigger extending from said handle, wherein said trigger controls said cleaning device via said drive unit;

a guide member extending from a forward end of said frame in front of said cleaning device to travel within said channel; and a roller extending from a rearward end of said frame behind said cleaning device to travel on top of said channel, wherein said roller vertically adjusts with respect to said cleaning device.

15. The railroad flangeway cleaner system of claim 14, wherein said frame includes a first adjustment member to adjust said frame longitudinally so as to adjust a distance of said guide member closer or further away from said cleaning device.

16. The railroad flangeway cleaner system of claim 14, wherein said handle is positioned at said rearward end of said frame behind said cleaning device.

17. A railroad flangeway cleaner system, comprising:

a frame for traveling along a channel of a railroad;

a drive unit attached to said frame;

a cleaning device connected to said drive unit, wherein said cleaning device clears said channel of debris;

a handle extending from said frame, wherein said handle is positioned at a rearward end of said frame behind said cleaning device;

a trigger extending from said handle, wherein said trigger is adapted to control said cleaning device via said drive unit; and a guide member extending from said frame, wherein said guide member is positioned at a forward end of said frame in front of said cleaning device;

wherein said guide member is adapted to engage said channel so as to move along said channel when clearing said channel of debris with said cleaning device;

wherein said drive unit is powered by hydraulics;

wherein said frame includes a first adjustment member to adjust said frame longitudinally;

wherein said first adjustment member adjusts a distance between said guide member and said cleaning device so as to move said guide member closer or further away from said cleaning device;

wherein said guide member is distally spaced with respect to said cleaning device;

wherein said guide member includes a first member and a second member to travel along a pair of inner edges of said channel;

wherein said frame includes a second adjustment member to adjust said frame vertically;

wherein said second adjustment member includes a roller to travel along a top of said channel;

wherein said roller is positioned at a rearward end of said frame behind said cleaning device;

wherein said cleaning device includes a plurality of stiff bristles;

wherein said cleaning device includes a plurality of blades extending along a pair of outer ends of said cleaning device;

wherein said frame includes a shroud to cover an upper half of said cleaning device;

wherein said cleaning device includes a front guard to extend over a front side of said cleaning device;

wherein said front guard is comprised of a flap configuration.

* * * * *